US008019109B2

(12) United States Patent
Gollbach et al.

(10) Patent No.: US 8,019,109 B2
(45) Date of Patent: Sep. 13, 2011

(54) MICROPHONE BOOM WITH ADJUSTABLE WIND NOISE SUPPRESSION

(75) Inventors: Lawrence Gollbach, Ben Lomond, CA (US); Timothy Johnston, Los Gatos, CA (US)

(73) Assignee: Plantronics, Inc., Santa Cruz ( * ) Notice: Subject to any disclaimer, the term of this patent is extended or adjusted under 35 U.S.C. 154(b) by 798 days.

(21) Appl. No.: 12/116,921

(22) Filed: May 7, 2008

(65) Prior Publication Data

US 2009/0279712 A1 Nov. 12, 2009

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/359; 381/360; 381/357

(58) Field of Classification Search ..... 381/355–363
See application file for complete search history.

(56) References Cited

U.S. PATENT DOCUMENTS

| | | | | |
|---|---|---|---|---|
| 4,012,605 | A * | 3/1977 | Jasinski | 381/347 |
| 6,091,830 | A * | 7/2000 | Toki | 381/359 |
| 6,424,724 | B1 * | 7/2002 | Ming-Cheng | 381/361 |
| 6,700,986 | B2 * | 3/2004 | Ootsu et al. | 381/357 |
| 6,771,789 | B2 * | 8/2004 | Kakinuma | 381/361 |
| 7,043,043 | B2 * | 5/2006 | Kakinuma | 381/361 |
| 2003/0194103 | A1 * | 10/2003 | Kakinuma | 381/361 |
| 2004/0258266 | A1 * | 12/2004 | Staat | 381/353 |
| 2005/0008182 | A1 * | 1/2005 | Kakinuma | 381/358 |

* cited by examiner

*Primary Examiner* — Elvin G Enad
*Assistant Examiner* — Alexander Talpalatskiy
(74) *Attorney, Agent, or Firm* — Intellectual Property Law Office of Thomas Chuang

(57) ABSTRACT

A microphone boom cap includes a porous plastic portion adapted to cover a microphone boom first aperture. The microphone boom cap includes a non-porous plastic portion affixed to the porous plastic portion. The non-porous plastic portion is adapted to cover a microphone boom second aperture in a second use position, where the porous plastic portion covers the second aperture in a first use position.

16 Claims, 6 Drawing Sheets

MICROPHONE BOOM WITH ADJUSTABLE WIND NOISE SUPPRESSION

BACKGROUND OF THE INVENTION

Communications headsets are used in a wide range of applications. Many headsets utilize some form of a microphone boom with a microphone located at the distal end of the boom so that it may be placed closer to the user's mouth. In other headsets, the microphone is located on a short boom closer to the headset receiver to achieve a more discreet appearance for the wearer.

One type of microphone commonly used is a noise canceling microphone. Noise canceling microphones (also referred to as differential or pressure gradient microphones) have two sound ports: a front port and a rear port. The front and rear ports act together to cancel out undesired ambient or background noise which arrives from a different angle and originates much further from the microphone than the voice of the user. Sound waves that arrive at opposite sides of the microphone diaphragm in equal phase and amplitude do not induce diaphragm vibration. This condition is referred to as acoustic cancellation.

In headset applications, a microphone boot assembly is oriented such that sound waves emanating from the desired sound source (i.e., the user's mouth) reach the front face of the diaphragm earlier and with greater amplitude than they reach the rear face of the diaphragm. Thus, acoustic cancellation is minimized. In contrast, sound waves emanating from sound sources that are located far away and in other directions arrive at opposite sides of the diaphragm closer in phase and amplitude, resulting in greater acoustic cancellation. Therefore, the microphone is less sensitive to ambient noise than to the user's voice. This process is referred to as noise cancellation.

Noise canceling microphones are susceptible to wind noise by their nature. Wind noise is caused by turbulent airflow around the headset boom front and/or rear ports to the microphone. This airflow causes random pressure fluctuations in the cavities coupled to the microphone. The noise canceling microphone undesirably converts this energy into noise in the audio signal, resulting in wind noise.

In the prior art, attempts to reduce the effects of wind noise have used folding booms. In the absence of wind, the folding boom is retracted to provide a discreet appearance. In windy conditions, the folding boom is extended to improve the signal-to-noise ratio. However, the use of a folding boom may provide only limited reduction of wind noise effects, and may be aesthetically undesirable to some users.

Thus, there is a need for improved methods and systems for wind noise suppression in microphone booms.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1A:
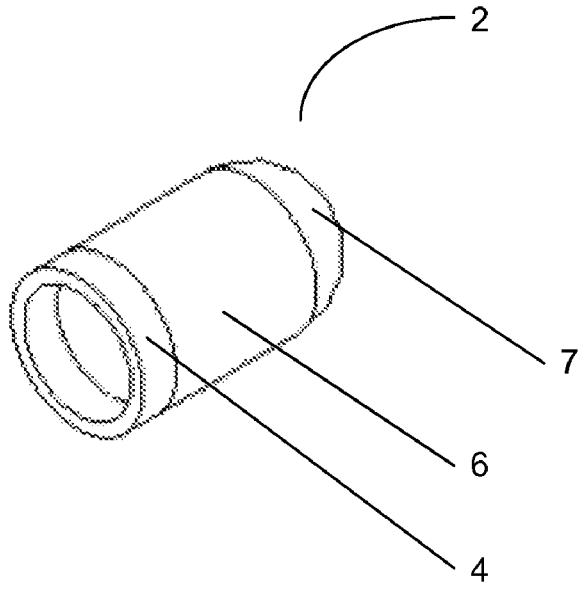
FIG. 1A illustrates a perspective view of a microphone boom cap in one example of the invention.

Methods and apparatuses for headset booms and microphone assemblies are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Generally, this description describes a method and apparatus for a microphone boom assembly with adjustable wind noise suppression. The invention relates generally to the fields of telephony, acoustics and electronics. In particular, this description describes headsets with noise canceling microphones that may be operated in windy environments. The invention is applicable to communication headsets, including corded headsets.

In one example of the invention, a device such as a cap operates at the end of a headset boom where a noise canceling microphone is located. The two ports of the noise canceling microphone are shielded by a porous plastic portion of the cap which allows the passage of sound. The cap includes a solid ring at the base which is not composed of porous plastic and which blocks the passage of sound. In operation, when winds are encountered, the user may slide the cap forward and close off the back port of the noise canceling microphone using the solid ring, thereby changing the microphone response to an omni-directional mode. When the winds subside, the cap is slid back to the original position for noise canceling performance again. In this manner, the user is able to deactivate the noise canceling feature of the microphone in windy environments to reduce wind noise while activating the noise canceling feature in non-windy environments to benefit from noise cancellation.

In one example, a headset microphone boom assembly includes a boom housing enclosing a noise canceling microphone. The boom housing includes a first aperture leading to a noise canceling microphone first port and a second aperture leading to a noise canceling microphone second port. The headset microphone boom assembly further includes a boom cap disposed over the boom housing movable relative to the boom housing to either a first use position or a second use position. The boom cap includes a porous plastic portion disposed over the first aperture in both the first use position and the second use position. The boom cap further includes a non-porous plastic portion disposed over the second aperture in the second use position, where the porous plastic portion covers the second aperture in the first use position.

In one example, a microphone boom cap includes a porous plastic portion adapted to cover a microphone boom first aperture. The boom cap includes a non-porous plastic portion affixed to the porous plastic portion adapted to cover a microphone boom second aperture in a second use position, where the porous plastic portion covers the second aperture in a first use position.

In one example, a microphone housing assembly includes a housing enclosing a noise canceling microphone. The housing includes a first aperture leading to a noise canceling microphone first port, a second aperture leading to a noise canceling microphone second port, and a tip portion. The microphone housing assembly further includes a wind noise suppression cap enclosing the tip portion operable to slide along a length of the housing between a first use position and a second use position. The wind noise suppression cap includes a porous plastic portion disposed over the first aperture in both the first use position and the second use position. The wind noise suppression cap further includes a non-porous plastic portion disposed over the second aperture in the second use position, where the porous plastic portion covers the second aperture in the first use position.

The microphone boom assembly described herein offers several advantages over prior art designs. Wind noise suppression is improved passively without the need for electronic signal processing. In addition, the user may select the operational mode of the boom assembly so that wind noise suppression is activated only when needed.

Figure 1B:
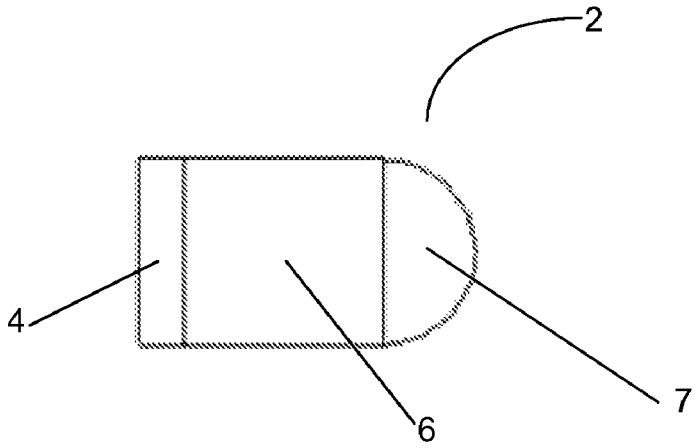
FIG. 1B illustrates a side view of the microphone boom cap shown in FIG. 1A.

FIG. 1A illustrates a perspective view of a microphone boom cap 2 in one example of the invention. FIG. 1B illustrates a side view of the microphone boom cap 2 shown in FIG. 1A. The microphone boom cap 2 includes a porous plastic portion, which in this design is in the form of a hollow porous plastic cylinder 6 having an end cap 7. The microphone boom cap 2 includes a non-porous plastic portion, which in this design is in the form of a non-porous plastic ring 4. The non-porous plastic ring 4 is affixed to porous plastic cylinder 6. The precise shape of the porous plastic portion and non-porous plastic portion may vary depending upon the headset boom to which it is attached. Generally, the cross-sectional shape of microphone boom cap 2 is designed so that it may ensleeve the headset boom. Where the headset boom has a circular cross-section, the diameter of the microphone boom cap 2 cross section is slightly larger than the diameter of the headset boom so that it may be placed over the headset boom. In further examples, the headset boom may have an elliptical or other shaped cross sections. The interior surface of microphone boom cap 2 should be molded in a shape to match the exterior surface of the headset boom and enable directional movement when the microphone boom cap 2 and headset boom are coupled.

In one embodiment, the pore density and size of the porous plastic portion is controlled so that it is acoustically transparent, and introduces no change in the frequency response of underlying transducer; in other embodiments, the pore size and density is controlled to provide adjust the frequency response of the transducer, for example, acting as a low pass filter, or the like. The porosity of the porous plastic portion makes it acoustically permeable, thereby enabling the microphone to pick up a speaker's voice and eliminates the need for holes.

In one example, porous plastic cylinder 6 is made from high-density polyethylene (HDPE). In further examples, porous plastic cylinder may be made from polytetrafluoroethylene (PTFE), ultra-high molecular weight polyethelene (UHMW), nylon 6 (N6), polypropylene (PP), polyvinylidine fluoride (PVDF), polyethylene (PE), and polyethersulfone (PES). Suitable characteristics for porous plastics in this application include a relatively random distribution of pores, average pore size in the range of about 50 to 500 micrometers, and a pore density whereby the pores comprise a relatively large percentage of the gross volume of the material, about 30 to 60%. One such material is POREX brand porous plastic manufactured by POREX CORPORATION of Fairburn, Ga. Other suppliers of porous plastics include GenPore, Inc. of Reading, Pa., and Porvair, PLC of Norfolk, England. In one example, the non-porous plastic portion is a material made from polycarbonate or acrylonitrile butadiene styrene (ABS).

Figure 2:
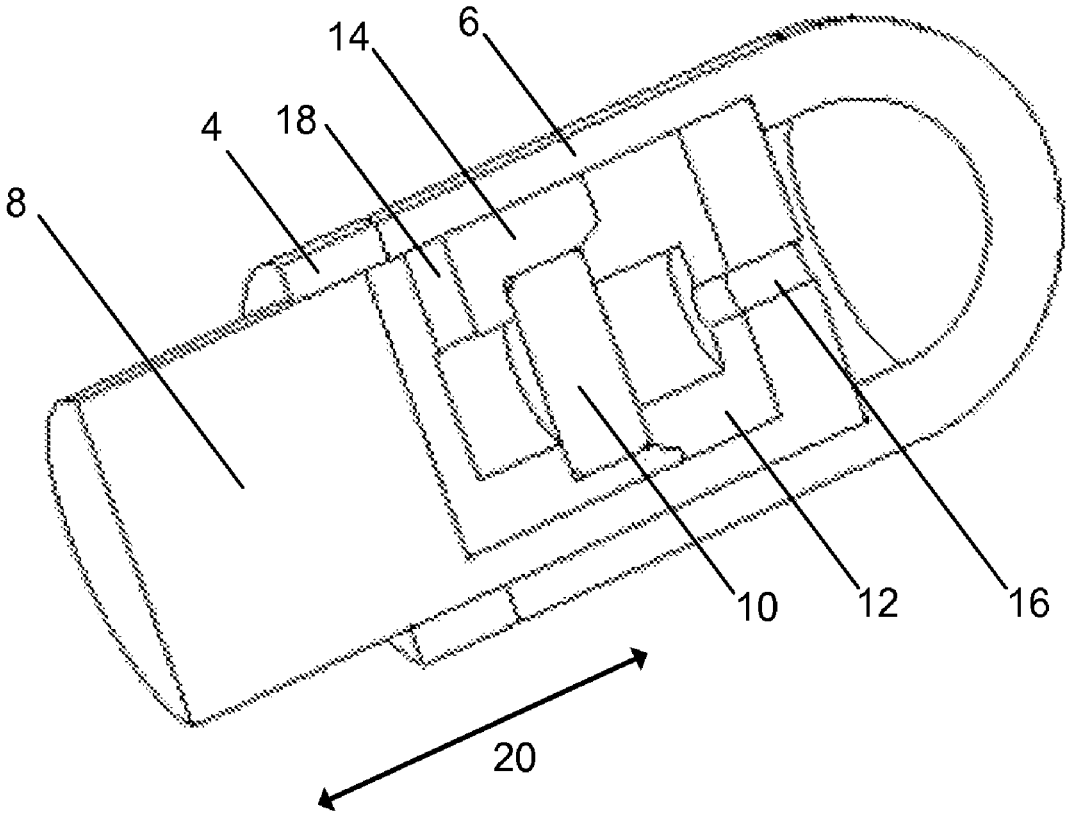
FIG. 2 illustrates a perspective cutaway view of a microphone boom cap disposed over a microphone boom in a first use position.

FIG. 2 illustrates a perspective cutaway view of the microphone boom cap 2 disposed over a headset microphone boom in a first use position. The headset microphone boom includes a boom housing 8 enclosing a noise canceling microphone 10. Boom housing 8 may, for example, be composed of molded plastic. Noise canceling microphone 10 is located near a tip 19 of boom housing 8. Microphone 10 divides an internal cavity of boom housing 8 into a front cavity holding a front boot 12 and a rear cavity holding a rear boot 14. The microphone 10 is commercially available and will not be discussed in detail herein except to note that it is a pressure-gradient microphone having a front port and rear port, where only the pressure difference between two acoustic input signals is transduced into an electrical signal by an acoustically sensitive membrane (not shown).

The boom housing 8 includes a front port 16 leading to the front boot 12 and a rear port 18 leading to the rear boot 14. Front boot 12 provides an acoustic channel between front port 16 and a microphone front port of noise canceling microphone 10. Rear boot 14 provides an acoustic channel between rear port 18 and a microphone rear port of noise canceling microphone 10. Noise canceling microphone 10 may be located at any suitable position in the boom housing 8. For example, microphone 10 may be located at either a near end or distal end of the boom housing 8. Front boot 12 and rear boot 14 may be composed of a flexible material such as urethane, and create an acoustic seal with the microphone 10 so that only the second entering from the front port 16 and rear port 18, respectively, can reach the microphone 10 diaphragm. The microphone 10, front boot 12, and rear boot 14 may be fitted together using a variety of means, including a frictional fit.

Microphone boom cap 2 is disposed over the boom housing 8 and movable relative to the boom housing 8 between either a first use position or a second use position. In the example shown in FIG. 2, microphone boom cap 2 is slideable along a length of the boom housing 8 in a direction 20 between the first use position and the second use position. In one example, a friction element disposed between the boom housing and the boom cap to allow the boom cap to slide along the length of the boom housing. For example, the friction element may be a polyurethane o-ring or washer with an inner diameter slightly greater than the diameter of the boom housing 8 so that the friction element may tightly fit over the boom housing 8.

In the first use position shown in FIG. 2, the microphone boom cap 2 porous plastic cylinder 6 is disposed over both the front port 16 and rear port 18. The non-porous plastic ring 4 is not disposed over the rear port 18. In this first use position, the microphone boom cap 2 is allows both the front port 16 and rear port 18 to receive acoustic energy, thereby enabling operation of noise canceling microphone 10 in a noise canceling mode. Acoustic energy impinges on the microphone diaphragm on both sides, causing the diaphragm to vibrate with the difference in sound pressure. As a result, the benefits of noise cancellation are realized.

Figure 3:
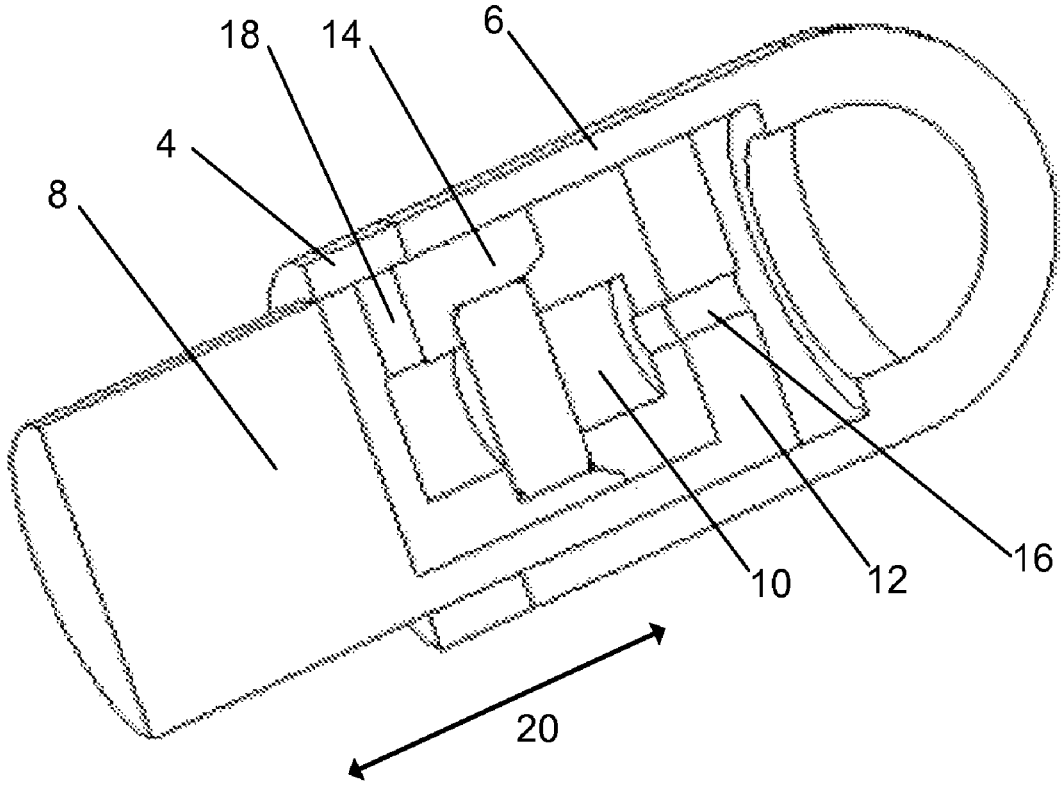
FIG. 3 illustrates a perspective cutaway view of a microphone boom cap disposed over a microphone boom in a second use position.

FIG. 3 illustrates a perspective cutaway view of a microphone boom cap 2 disposed over the headset microphone boom in a second use position. In the second use position shown in FIG. 3, porous plastic cylinder 6 is disposed over the front port 16. The non-porous plastic ring 4 has been moved forward so that it is disposed over rear port 18 in the second use position. In this second use position, the non-porous plastic ring 4 blocks all wind airflow from entering rear port 18, thereby enabling operation of noise canceling microphone 10 in an omni-directional mode to reduce the effects of wind noise. As a result, a high degree of wind noise reduction is achieved as compared to the first use position illustrated in FIG. 2.

Figure 4A:
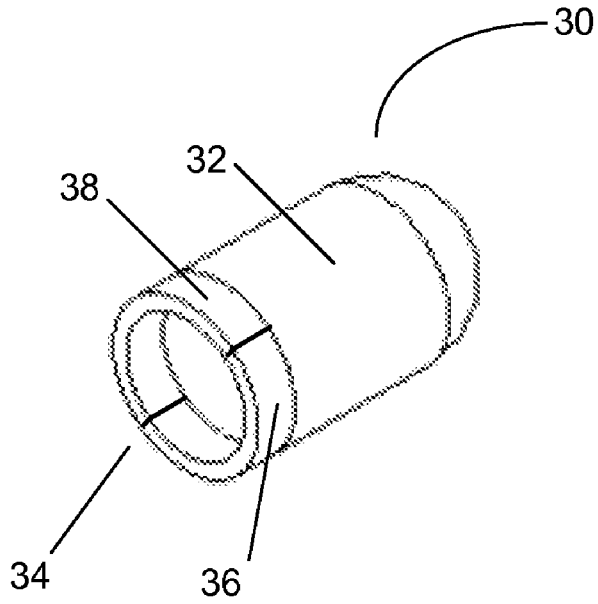
FIG. 4A illustrates a perspective view of a microphone boom cap in a further example of the invention.
Figure 4B:
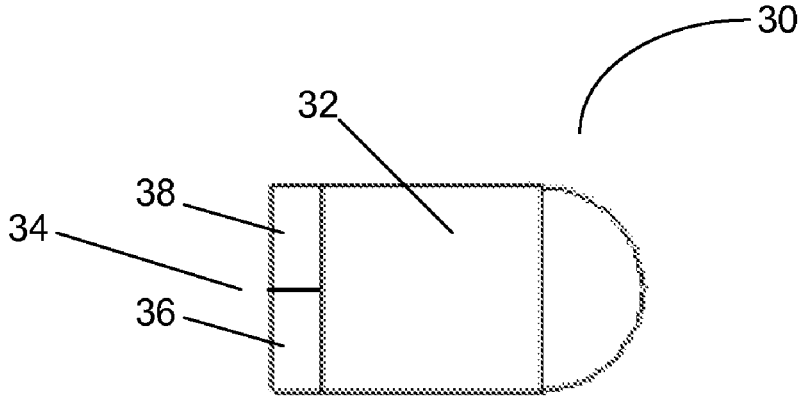
FIG. 4B illustrates a side view of the microphone boom cap shown in FIG. 4A.

FIG. 4A illustrates a perspective view of a microphone boom cap 30 in a further example of the invention. FIG. 4B illustrates a side view of the microphone boom cap 30 shown in FIG. 4A. The microphone boom cap 30 includes a porous plastic portion in the form of porous plastic cylinder 32 and a cap end portion in the form of a ring 34. Ring 34 is composed of both a porous plastic portion 36 and a non-porous plastic portion 38. In one example, the ring 34 is half non-porous plastic and half porous plastic. In further examples, the ratio of non-porous plastic to porous plastic of ring 34 may be varied as long as there is a sufficient portion of the circumference of both materials to cover rear port 48.

Figure 5:
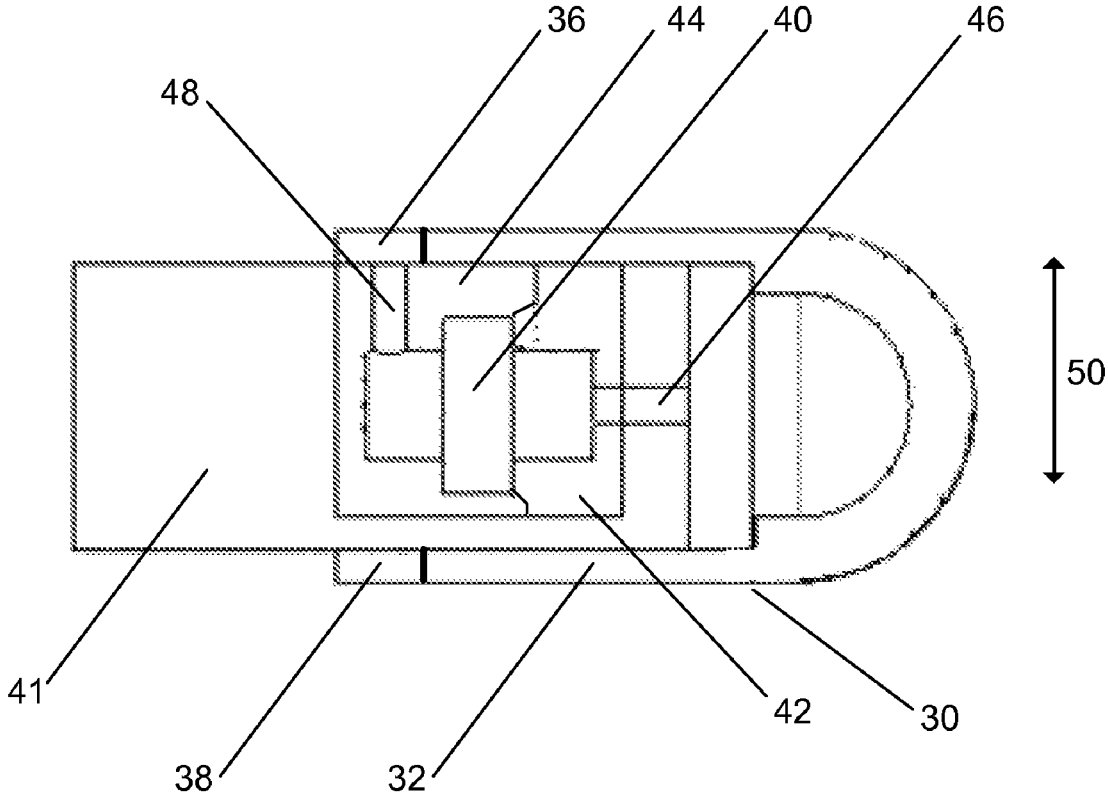
FIG. 5 illustrates a side cutaway view of a microphone boom cap disposed over a microphone boom in a first use position in a further example of the invention.

FIG. 5 illustrates a side cutaway view of the microphone boom cap 30 disposed over a microphone boom in a first use position in a further example of the invention. The headset microphone boom includes a boom housing 41 enclosing a noise canceling microphone 40. The boom housing 41 includes a front port 46 leading to a front boot 42 and a rear port 48 leading to a rear boot 44. Front boot 42 provides an acoustic channel between front port 46 and a microphone front port of noise canceling microphone 40. Rear boot 44 provides an acoustic channel between rear port 48 and a microphone rear port of noise canceling microphone 40.

Microphone boom cap 30 is disposed over the boom housing 41 and movable relative to the boom housing 41 between either a first use position or a second use position. In the example shown in FIG. 5, microphone boom cap 30 is rotatable about the boom housing 41 in a direction 50 between the first use position and the second use position. In the first use position shown in FIG. 5, the microphone boom cap 30 porous plastic cylinder 32 is disposed over the front port 46 and the porous plastic portion 36 is disposed over the rear port 48. The non-porous plastic portion 38 is not disposed over the rear port 48. In this first use position, the microphone boom cap 30 allows both the front port 46 and rear port 48 to receive acoustic energy, thereby enabling operation of noise canceling microphone 40 in a noise canceling mode. Acoustic energy impinges on the microphone diaphragm on both sides, causing the diaphragm to vibrate with the difference in sound pressure. As a result, the benefits of noise cancellation are realized.

Figure 6:
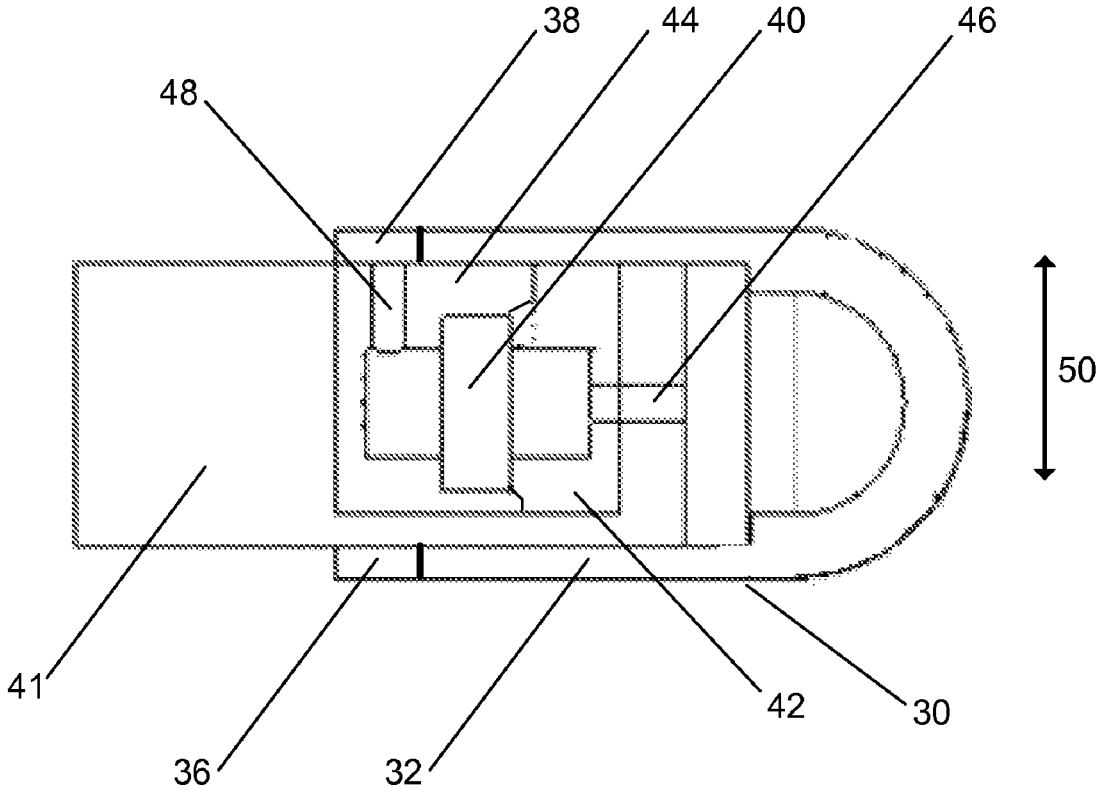
FIG. 6 illustrates a side cutaway view of a microphone boom cap disposed over a microphone boom in a second use position in a further example of the invention.

FIG. 6 illustrates a side cutaway view of the microphone boom cap 30 disposed over a microphone boom in a second use position in a further example of the invention. In the second use position shown in FIG. 6, porous plastic cylinder 32 is disposed over the front port 46. The ring 34 has been rotated about the boom housing 41 so that non-porous plastic portion 38 is now disposed over the rear port 48. In this second use position, the non-porous plastic portion 38 blocks all wind airflow from entering rear port 48, thereby enabling operation of noise canceling microphone 40 in an omni-directional mode to greatly reduce the effects of wind noise. As a result, a high degree of wind noise reduction is achieved as compared to the first use position illustrated in FIG. 5.

In one example, the microphone boom cap 30 is fabricated to have a tight slip fit between the outer diameter of the boom housing 41 and the inner bore of the microphone boom cap 30. A stop mechanism is included in the microphone boom cap 30 to restrict the cap from coming off the end of the boom during use. The stop mechanism can be implemented using a cantilevered boom with a peg which mates with a corresponding slot in the boom to limit transverse motion in the linear case or limit rotation in the rotary case.

The various examples described above are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. Such modifications and changes do not depart from the true spirit and scope of the present invention that is set forth in the following claims.

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Description of Specific Embodiments as an embodiment of the invention.

What is claimed is:

1. A headset microphone boom assembly comprising:

a boom housing enclosing a noise canceling microphone, the boom housing comprising a first aperture leading to a noise canceling microphone first port and a second aperture leading to a noise canceling microphone second port; and a boom cap disposed over the boom housing movable relative to the boom housing to either a first use position or a second use position, the boom cap comprising:

a porous plastic portion disposed over the first aperture in both the first use position and the second use position; and a non-porous plastic portion disposed over the second aperture in the second use position, wherein the porous plastic portion covers the second aperture in the first use position.

2. The headset microphone boom assembly of claim 1, wherein the boom cap is rotatable about the boom housing between the first use position and the second use position.

3. The headset microphone boom assembly of claim 1, wherein the boom cap is slideable along a length of the boom housing between the first use position and the second use position.

4. The headset microphone boom assembly of claim 1, wherein the porous plastic portion comprises one selected from the following group: high-density polyethylene (HDPE), polytetrafluoroethylene (PTFE), ultra-high molecular weight polyethelene (UHMW), nylon 6 (N6), polypropylene (PP), polyvinylidine fluoride (PVDF), polyethylene (PE), and polyethersulfone (PES).

5. The headset microphone boom assembly of claim 1, wherein the non-porous plastic portion comprises polycarbonate or acrylonitrile butadiene styrene.

6. The headset microphone boom assembly of claim 1, wherein the non-porous plastic portion comprises a cylindrical ring affixed to the porous plastic portion.

7. The headset microphone boom assembly of claim 1, wherein the non-porous plastic portion comprises a first half cylindrical ring affixed to a porous plastic second half cylindrical ring.

8. The headset microphone boom assembly of claim 1, further comprising a friction element disposed between the boom housing and the boom cap.

9. The headset microphone boom assembly of claim 8, wherein the friction element comprises a rubber o-ring.

10. A microphone housing assembly comprising:

a housing enclosing a noise canceling microphone, the housing comprising:

a first aperture leading to a noise canceling microphone first port; and a second aperture leading to a noise canceling microphone second port;

a tip portion;

a wind noise suppression cap enclosing the tip portion operable to slide along a length of the housing between a first use position and a second use position, the wind noise suppression cap comprising:

a porous plastic portion disposed over the first aperture in both the first use position and the second use position; and a non-porous plastic portion disposed over the second aperture in the second use position, wherein the porous plastic portion covers the second aperture in the first use position.

11. The microphone housing assembly of claim 10, wherein the porous plastic portion comprises one selected from the following group: high-density polyethylene (HDPE), polytetrafluoroethylene (PTFE), ultra-high molecular weight polyethelene (UHMW), nylon 6 (N6), polypropylene (PP), polyvinylidine fluoride (PVDF), polyethylene (PE), and polyethersulfone (PES).

12. The microphone housing assembly of claim 10, wherein the non-porous plastic portion comprises polycarbonate or acrylonitrile butadiene styrene.

13. The microphone housing assembly of claim 10, wherein the non-porous plastic portion comprises a cylindrical ring affixed to the porous plastic portion.

14. The microphone housing assembly of claim 10, wherein the non-porous plastic portion comprises a first half cylindrical ring affixed to a porous plastic second half cylindrical ring.

15. The microphone housing assembly of claim 10, further comprising a friction element disposed between the housing and the wind noise suppression cap.

16. The microphone housing assembly of claim 15, wherein the friction element comprises a rubber o-ring.

* * * * *